United States Patent [19]

Perricone

[11] Patent Number: 4,762,175

[45] Date of Patent: Aug. 9, 1988

[54] APPARATUS FOR CONNECTING JARS TO A DOWNHOLE TOOL

[75] Inventor: James M. Perricone, Spring, Tex.

[73] Assignee: Petro-Tech Tools Incorporated, Houston, Tex.

[21] Appl. No.: 46,313

[22] Filed: May 6, 1987

[51] Int. Cl.[4] ..... E21B 31/107

[52] U.S. Cl. ..... 166/63; 166/178

[58] Field of Search ..... 166/63, 178, 98, 99, 166/301; 294/86.23, 86.1

[56] References Cited

U.S. PATENT DOCUMENTS

| | | | |
|---|---|---|---|
| 2,637,402 | 5/1953 | Baker et al. | 166/63 X |
| 3,211,222 | 10/1965 | Myers | 166/63 |
| 3,244,232 | 4/1966 | Myers | 166/63 |
| 3,343,606 | 9/1967 | Dollison | 166/178 X |

*Primary Examiner*—Jerome Massie
*Assistant Examiner*—Hoang C. Dang
*Attorney, Agent, or Firm*—Vaden, Eickenroht, Thompson & Boulware

[57] ABSTRACT

Apparatus is disclosed for connecting the firing head of a downhole tool to a set of jars to allow the jars to jar up and jar down. The apparatus includes a firing head housing, a hammer located in the housing, and a spring urging the hammer toward a firing pin. A mandrel extends into the housing. It has one end connected to a jar and the other end connected to the hammer by a shear pin. The mandrel also has longitudinally spaced oppositely facing shoulders and one or more lock segments around the mandrel between the shoulders. The movement of the lock segments along the axis of the housing is limited and the lock segments engage the oppositely facing shoulders to limit axial movement of the mandrel relative to the housing in either direction when the pin is sheared and the hammer released to strike the firing pin.

14 Claims, 3 Drawing Sheets

FIG. 2
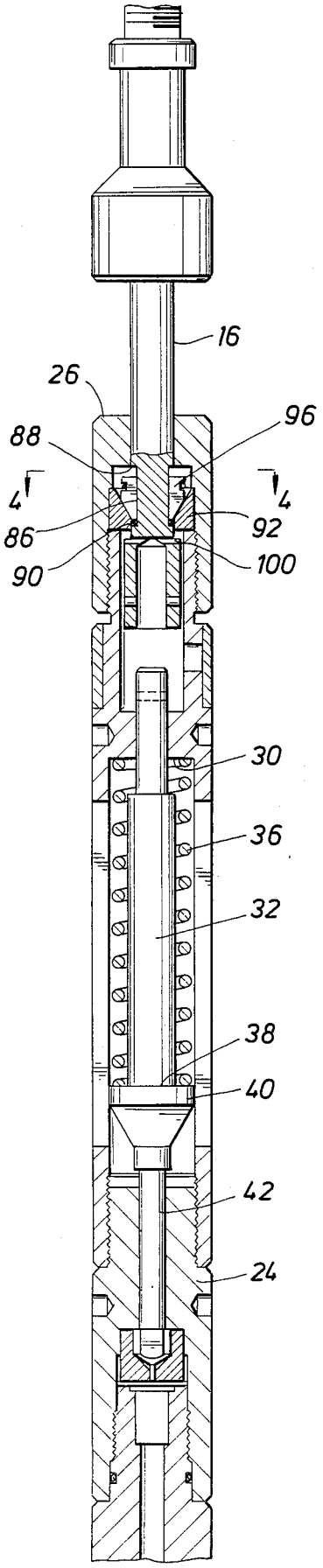
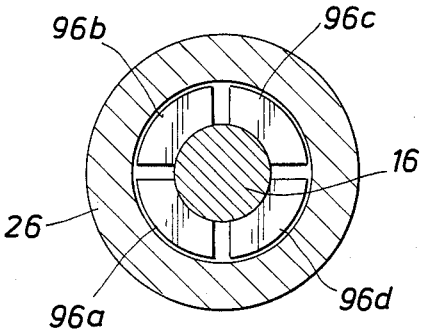
FIG. 3
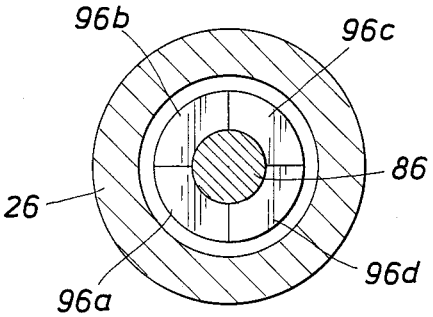
FIG. 4

APPARATUS FOR CONNECTING JARS TO A DOWNHOLE TOOL

This invention relates to apparatus for connecting jars to downhole tools generally, and in particular, to apparatus for connecting the firing head of a downhole pulling tool to a set of wireline jars to allow the jars to jar up and to also jar down both before and after the firing head has been actuated.

This invention has utility for connecting jars to any downhole tool that requires a jarring action to actuate the downhole tool. It has particular utility when used with a pressure actuated wireline pulling and pushing tools of the type described in U.S. Pat. No. 3,211,222 which issued Oct. 12, 1965 to W. D. Myers, and U.S. Pat. No. 3,244,232, which issued Apr. 15, 1963 also to W. D. Myers.

Both of these patents describe fishing tools that are run on a wireline. The tools are actuated by a firing head that ignites a fast burning powder to generate high pressure gases that act through a piston and cylinder arrangement to exert an upward pull on a fish in the well bore. The firing head includes a striker or hammer that is connected to the mandrel that supports the tool by a shear pin. When the pin is sheared, usually with the help of one or more sets of jars connected to the mandrel, a coil spring located between the mandrel and the hammer drives the hammer downwardly against the firing pin with sufficient force to fire a blank cartridge, which in turn, ignites the main body of combustible material that supplies the gases under pressure.

This arrangement works fine except when it is desired to jar down on the tool. Any downward force exerted by the jars before the tool has been actuated, as for example in an attempt to drive an overshot over the end of the fish, would be transmitted directly to the shear pin connecting the hammer and the mandrel and consequently any such jarring would have to be done very selectively in order to avoid prematurely actuating the device. After the device has been actuated, if the fish has not come loose, then it may be desirable to jar down as well as to jar up on the fish in an effort to free the fish. Further, some tools used to connect the pulling tool to the fish can be released by jarring down. At this point, however, the coil spring that provided the energy to drive the hammer against the firing pin is located between the mandrel and anything solid. Consequently most, if not all of the downward force transmitted to the mandrel by a jar will be absorbed by the spring and have little or no effect on the tool itself.

It is an object of this invention to provide apparatus for connecting a downhole tool, which is actuated by shearing a pin, to a set of jars that will allow the jars to both jar up and jar down.

It is a further object of this invention to provide apparatus for connecting the firing head of a downhole tool to a set of wireline jars to allow the jars to jar up and jar down both before and after the firing head has been triggered to actuate the downhole tool.

These and other objects, advantages, and features of this invention will be apparent to those skilled in the art from a consideration of the specification including the attached drawings and appended claims.

IN THE DRAWINGS

FIGS. 1A, 1B, and 1C together constitute a longitudinal section through a pulling tool that includes apparatus in accordance with this invention for connecting the tool to a jar to allow the jar to strike both a downward and an upward force on the tool.

FIG. 2 is a sectional view of the firing head of FIG. 1A after the firing head has been actuated.

FIG. 3 is a cross-sectional view taken along line 3—3 of FIG. 1A.

FIG. 4 is a cross-sectional view taken along line 4—4 of FIG. 2.

Figure 1A:
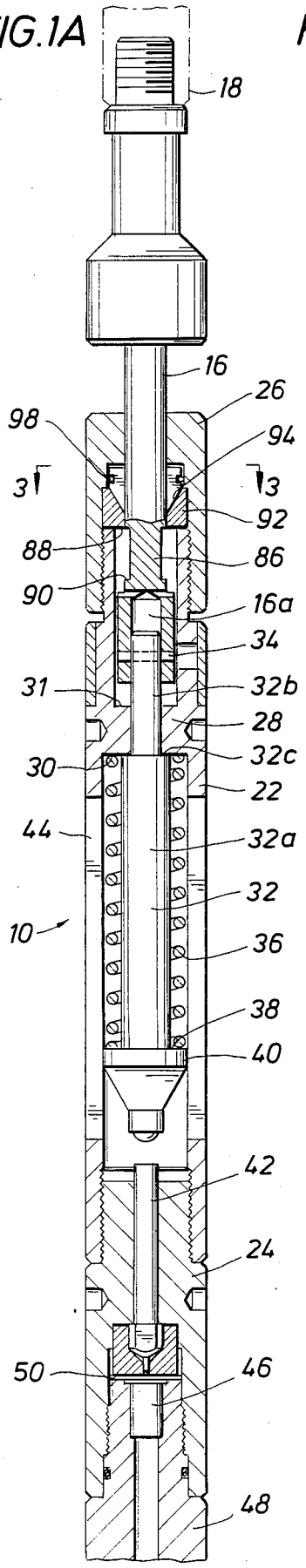
Figure 1B:
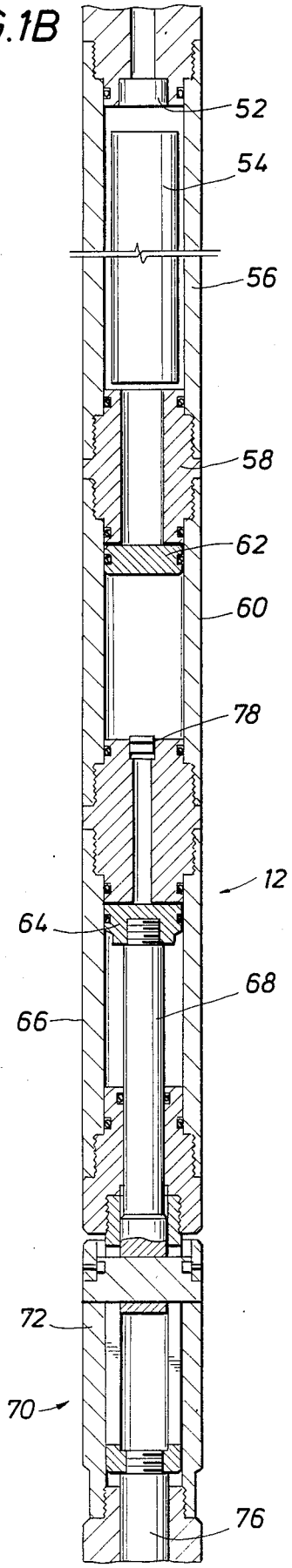

The pulling tool comprises three subassemblies. Firing head subassembly 10 is shown in FIG. 1A. Power generator subassembly 12 is shown in FIG. 1B and slip subassembly 14 is shown primarily in FIG. 1C. The tool is connected to and supported by mandrel 16, which is connected directly to wireline jars 18 shown in dashed lines in FIG. 1A. The lower end of the tool is connected to a fishing tool, generally indicated by the number 20, the most commonly used type being the overshot. The tool and the jars can be run on a wireline or a pipe string.

The firing head assembly includes housing 22 that is connected at its lower head to firing pin crossover sub 24 and at its upper end to cap 26. Below the upper end of the housing is section 28 of reduced internal diameter to provide downwardly facing shoulder 30. Firing pin striker or hammer 32 has a section of enlarged diameter **32*a* having upwardly facing shoulder 32*c* to engage shoulder 30. Section 32*b* of the hammer is of reduced diameter and extends through the opening in section 28 of the housing into opening 16*a* of the mandrel. The upper end of the hammer is connected to the lower end of the mandrel by shear pin 34. The weight of the well tool is supported by mandrel 16 and shear pin 34 by the engagement of upwardly facing shoulder 32*c* on the striker and downwardly facing shoulder 30 provided by housing section 28** of decreased diameter.

Coil spring 36 is positioned between shoulder 30 and upwardly facing shoulder 38 provided by enlarged diameter guide section 40 on the lower end of the hammer. In the position shown, the coil spring is compressed between the opposing shoulders so that when shear pin 34 fails, as shown in FIG. 2, the spring will drive the hammer downwardly to engage firing pin 42 mounted in firing pin crossover sub 24. Slots 44 in the side of housing 22 allow the fluid in the well bore to enter the housing and maintain equal pressure on all the components of the firing head above firing pin sub 24.

Blank cartridge 46 is positioned in breech block 48 below firing pin 42. Copper disc 50 is located between the cartridge and the firing pin. The copper plate will yield sufficiently under the impact of hammer 32 to allow firing pin 42 to fire cartridge blank 48 without rupturing. The flame from blank cartridge 48 ignites a secondary igniter 52, which in turn ignites main charge 54 located in cylindrical housing 56. The copper plate serves as a seal to keep the gases generated by the firing of the cartridge from escaping.

Connected in the assembly below housing 56 through crossover sub 58 is piston chamber or cylinder 60, in which piston 62 is located. Piston 62 is held in the upper position shown in FIG. 1B because cylinder 60 is filled with hydraulic fluid. Hydraulic fluid is maintained in cylinder 60 by piston 64 in cylinder 66. Piston 64 is connected to piston rod 68, which, through crossover 70, causes the downward force exerted on piston 64 by the hydraulic fluid being transferred out of cylinder 60 into cylinder 66 by piston 62, to outer crossover member 72 and to tapered slip expander head 74. The upward reactionary force on cylinder 66 and the assemblies thereabove is transferred through the crossover to lower piston rod 76 which exerts upward force on fishing tool 60 and the fish to which it is connected.

The relative movement of slips 80 (usually three or more) and slip expander head 74 will shear pin 82, which had previously served to hold the members in the position shown, and cause the slips to move outwardly into engagement with casing 83 and anchor the expander head from further downward movement. This relieves the wireline or tubing of the downward force in rod 68.

The transfer of hydraulic fluid from cylinder 60 to cylinder 66 to move piston 64 downwardly is slowed by choke 78 to allow the setting of slips 80 and the shearing of shear pin 82 to take place over a reasonable period of time.

If it is necessary to strike a downward blow on the tool with the jars because the tool hangs up while it is being run into the well bore, or to force the overshot over the fish, it can be done with the apparatus of this invention by lowering mandrel 16 until it engages shoulder 31 provided by section 28 of the housing. In this position, any downward blows from the jar will be transmitted directly through the well tool to the fishing tool.

Means are provided to lock the tool to the mandrel so that the jars can apply blows to the well tool either upwardly or downwardly as desired after the tool has been actuated. In the embodiment shown in FIGS. 1–4, mandrel 16 has section 86 of reduced diameter providing oppositely facing shoulders 88 and 90. Positioned in cap 26 above the mandrel section 86 of reduced diameter before the tool is actuated is annular member 92. This member has upwardly and outwardly tapered surface 94 encircling the mandrel. This surface is also in engagement with tapered surfaces 94 of four lock segments **96*a*–96*d***.

As shown in FIG. 3, before the firing head is triggered, the segments are in engagement with a portion of the mandrel of enlarged diameter so that the mandrel is free to move downwardly relative to the lock members or segments at this point. The lock segments are urged inwardly against the surface of the mandrel by garter spring 98. So when pin 34 is sheared to actuate the fishing tool, the mandrel moves upwardly relative to the tool to the position shown in FIG. 2 allowing lock segments 96 to move into engagement with section 86 of reduced diameter. Downward movement of the mandrel now will move shoulder 88 into engagement with the upper surface of lock segments 96, which in turn are in engagement with the tapered surface on annular member 92. As a result, downward blows by the jars will be transmitted through the tool to the fish. Conversely, if it is desired to jar up on the tool, upward movement of the mandrel will move shoulder 100 on the mandrel into engagement with the bottom surface of annular member 92 and upward blows will be transmitted directly to the well tool.

Figure 1C:
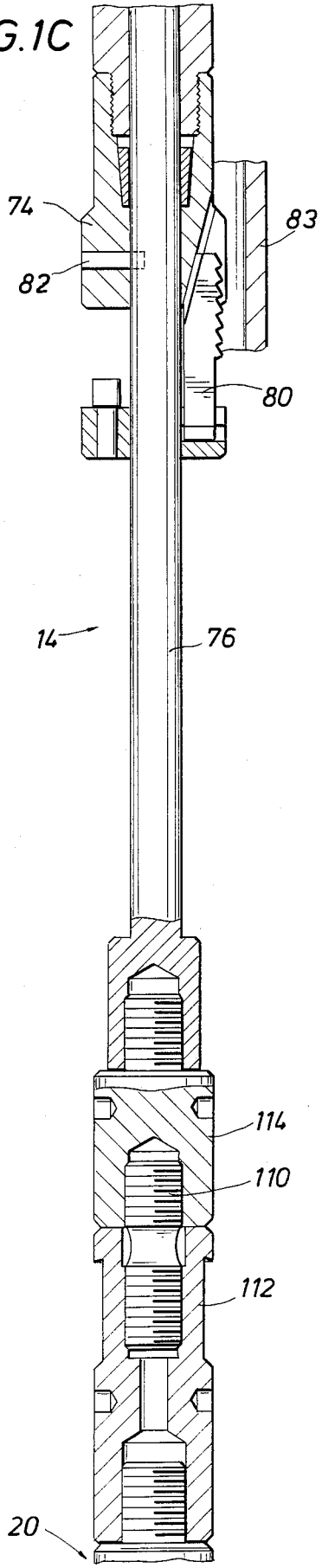

It is very important to be able to jar either up or down as desired. For example, if the fish does not come loose and a fishing tool, such as an overshot is used that is released by jarring down on the overshot, then by jarring downward on the tool, the fishing tool can be released from the fish and the entire tool can be removed from the well bore. Conversely, if the fishing tool cannot be released from the fish, stud 110, as shown in FIG. 1C, that connects fishing neck 112 to bottom connection 114 on the lower end of rod 76 has been reduced in diameter so that it will fail at a predetermined tensile force. This releases everything above the stud for removal from the well bore and leaves fishing neck 112 in position to be engaged by another overshot to continue the fishing operation.

Figure 5:
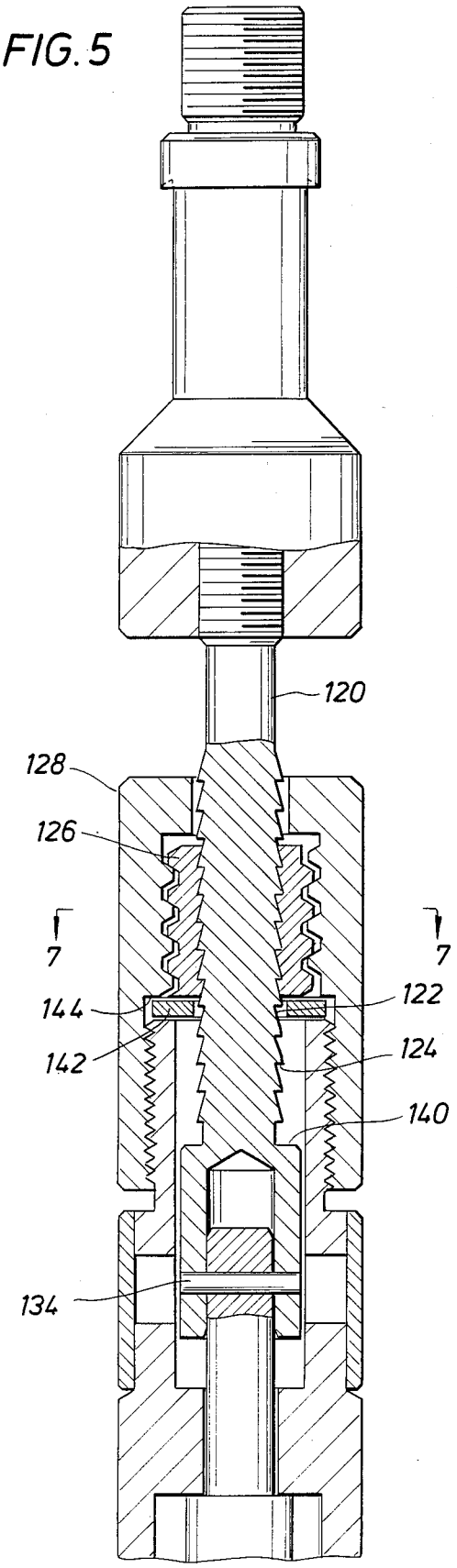
FIG. 5 is an alternate embodiment of the apparatus of this invention for connecting a pulling tool to a jar.
Figure 6:
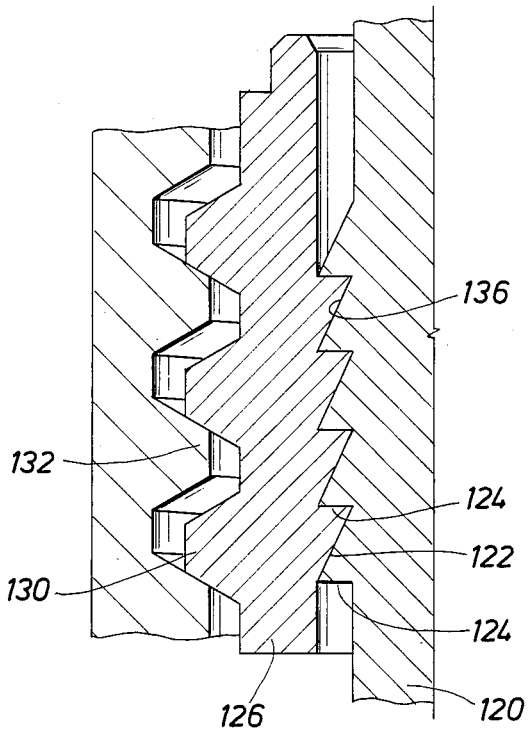
FIG. 6 is a view on an enlarged scale of the portion of FIG. 6 in circle 6.
Figure 7:
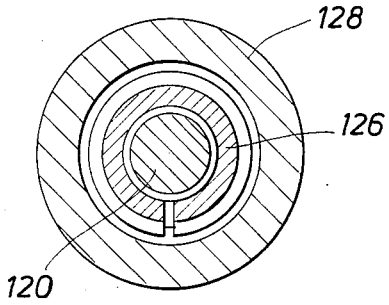
FIG. 7 is a cross-sectional view taken along line 7—7 of FIG. 5.

An alternate embodiment of the apparatus of this invention is shown in FIGS. 5 and 6. Here mandrel 120 is provided with buttress type threads 122 having force transmitting flank 124 looking downwardly. Lock segment 126, comprising a longitudinally split annular member, is located in cap 128 and surrounds the mandrel. The lock segment has external threads 130, here shown as modified Acme threads, that mate with female threads 132 on the inside of cap 128. The inner surface of the lock segment has buttress threads that mate with the buttress threads on mandrel 120, as shown in FIG. 6. Force transmitting flanks 124 of the buttress threads and upwardly facing shoulder 140 function as oppositely facing shoulders on the mandrel and the inclined surfaces of thread 130 and 132 same as means urging the lock segment toward the mandrel.

As shown in FIG. 6, after shear pin 134 has been sheared, any downward force imparted on the mandrel by the jars connected to the mandrel will be transmitted through the mating buttress threads through mating threads 130 and 132 to cap 128 and downwardly through the tool to the fish. Upward movement of the mandrel will cause the inclined flanks 136 of the buttress thread on the mandrel to cam the locking segment outwardly into the space allowed by female thread 132 on the cap. Thus, the buttress threads can ratchet allowing the mandrel to move upwardly until shoulder 140 on the mandrel below the buttress threads engages washer 142 which then moves up and engages downwardly facing shoulder 144 of cap 128. The cap then will prevent any further upward movement of the mandrel relative to the tool and the jars can exert an upward force on the mandrel and to the tool.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for connecting the firing head of a downhole tool to a set of jars to allow the jars to jar up and jar down comprising a firing head housing, a hammer located in the housing, resilient means urging the hammer toward a firing pin, a mandrel extending into the housing having one end adapted for connecting to a jar and the other end connected to the hammer by a shear pin, said mandrel having spaced oppositely facing shoulders, lock segment means spaced around the mandrel, means limiting the movement of the lock segment means along the axis of the housing, and means urging the lock segment means toward the mandrel to move the lock segment means into position to engage the oppositely facing shoulders to limit axial movement of the mandrel relative to the housing in either direction when the pin is sheared and the hammer released to strike the firing pin.

2. The apparatus of claim 1 in which the downhole tool is a pulling tool for exerting an upward force on a fish when the tool is actuated.

3. The apparatus of claim 2 in which the downhole tool includes a fishing tool for connecting the pulling tool to a fish that is released by jarring downwardly on the fishing tool.

4. The apparatus of claim 1 in which the mandrel has a section of reduced diameter between the shoulders into which the lock segment move when the pin is sheared.

5. The apparatus of claim 1 in which one of the oppositely facing shoulders is a buttress thread on the mandrel and a mating buttress thread on the lock segment means that allow upward movement of the mandrel relative to the housing and prevent downward movement.

6. Apparatus for connecting the firing head of a downhole tool to a set of jars to allow the jars to jar up and jar down comprising a firing head housing, a hammer located in the housing, resilient means urging the hammer toward a firing pin, a mandrel extending into the housing having one end adapted for connecting to a jar and the other end connected to the hammer by a shear pin, said mandrel having a section of reduced diameter providing oppositely facing shoulders, a plurality of lock segments spaced around the mandrel, means limiting the movement of the lock segments along the axis of the housing, and means urging the lock segments toward the mandrel to move the lock segments into position on the section of reduced diameter between the oppositely facing shoulder to limit axial movement of the mandrel relative to the housing in either direction when the pin is sheared and the hammer released to strike the firing pin.

7. The apparatus of claim 6 in which the downhole tool is a pulling tool for exerting an upward force on a fish when the tool is actuated.

8. The apparatus of claim 7 in which the downhole tool includes a fishing tool for connecting the pulling tool to a fish that is released by jarring downwardly on the fishing tool.

9. An apparatus for exerting a force on a fish in a well bore, said apparatus having a fishing tool for connecting to the fish, cylinder means, piston means in the cylinder means and movable downwardly therein relative to the cylinder, force transmitting means connecting the cylinder means to the fishing tool, slip means carried by the force transmitting means, expander means connected to the piston means to engage the slip means upon movement of the piston means relative to the cylinder means to move the slip means into engagement with the inside wall of the well bore, and means providing a fluid under pressure in the cylinder means for shifting the piston means downwardly relative to the cylinder means to cause the cylinder means to move upwardly and exert an upward force on the fishing tool to exert a force on the fish, the improvement comprising means connecting the apparatus to a jar to allow the jar to jar up and jar down, said means including a firing head housing, a hammer located in the housing, resilient means urging the hammer toward a firing pin, a mandrel extending into the housing having one end adapted for connecting to a wireline jar and the other end connected to the hammer by a shear pin, said mandrel having spaced oppositely facing shoulders, a plurality of lock segments spaced around the mandrel, means limiting the movement of the lock segments along the axis of the housing, and means urging the lock segments toward the mandrel to move the lock segments into position to engage the oppositely facing shoulders to limit axial movement of the mandrel relative to the housing in either direction when the pin is sheared and the hammer released to strike the firing pin.

10. The apparatus of claim 9 in which the fishing tool for connecting the apparatus to a fish is released by jarring downwardly on the fishing tool.

11. The apparatus of claim 9 in which the mandrel has a section of reduced diameter between the shoulders into which the lock segments move when the pin is sheared.

12. The apparatus of claim 9 in which one of the oppositely facing shoulders is a buttress thread on the mandrel and a mating buttress thread on the lock segments that allow upward movement of the mandrel relative to the housing and prevent downward movement.

13. An apparatus for exerting a force on a fish in a well bore, said apparatus having a fishing tool for connecting to the fish, cylinder means, piston means in the cylinder means and movable downwardly therein relative to the cylinder, force transmitting means connecting the cylinder means to the fishing tool, slip means carried by the force transmitting means, expander means connected to the piston means to engage the slip means upon movement of the piston means relative to the cylinder means to move the slip means into engagement with the inside wall of the well bore, and means providing a fluid under pressure in the cylinder means for shifting the piston means downwardly relative to the cylinder means to cause the cylinder means to move upwardly and exert an upward force on the fishing tool to exert a force on the fish, the improvement comprising means connecting the apparatus to a jar to allow the jar to jar up and jar down, said means including a firing head housing, a hammer located in the housing, resilient means urging the hammer toward a firing pin, a mandrel extending into the housing having one end adapted for connecting to a wireline jar and the other end connected to the hammer by a shear pin, said mandrel having an external buttress type thread providing a plurality of downwardly facing shoulders, a lock segment comprising a split annular member surrounding the mandrel, said segment having internal buttress threads that mate with the buttress threads on the mandrel, said segment being movable laterally of the housing sufficiently to allow the threads to ratchet when the mandrel is moved upwardly relative to the housing, means limiting the movement of the lock segment along the axis of the housing, and means urging the lock segment toward the mandrel to move the lock segment into position for the buttress threads on the segment and the mandrel to engage and limit axial movement of the mandrel downwardly relative to the housing and an upwardly facing shoulder on the mandrel to engage the lock segment and limit upward movement of the mandrel relative to the housing when the pin is sheared and the hammer released to strike the firing pin.

14. The apparatus of claim 13 in which the fishing tool for connecting the apparatus to a fish is released by jarring downwardly on the fishing tool.

* * * * *